US006307141B1

(12) United States Patent
Laroche et al.

(10) Patent No.: US 6,307,141 B1
(45) Date of Patent: Oct. 23, 2001

(54) METHOD AND APPARATUS FOR REAL-TIME BEAT MODIFICATION OF AUDIO AND MUSIC SIGNALS

(75) Inventors: Jean Laroche; Luke Dahl, both of Santa Cruz, CA (US)

(73) Assignee: Creative Technology Ltd., Singapore (SG)

( * ) Notice: Subject to any disclaimer, the term of this patent is extended or adjusted under 35 U.S.C. 154(b) by 0 days.

(21) Appl. No.: 09/693,438

(22) Filed: Oct. 20, 2000

Related U.S. Application Data

(63) Continuation-in-part of application No. 09/378,279, filed on Aug. 20, 1999, and a continuation-in-part of application No. 09/378,377, filed on Aug. 20, 1999.

(60) Provisional application No. 60/117,154, filed on Jan. 25, 1999.

(51) Int. Cl.[7] ..... G10H 1/40

(52) U.S. Cl. ..... 84/636; 84/DIG. 12

(58) Field of Search ..... 84/611, 612, 635, 84/636, DIG. 12

(56) References Cited

U.S. PATENT DOCUMENTS

| | | | | |
|---|---|---|---|---|
| 4,694,724 | * | 9/1987 | Kikumoto et al. | 84/612 |
| 5,256,832 | * | 10/1993 | Miyake | 84/636 |
| 5,270,477 | * | 12/1993 | Kawashima | 84/636 X |
| 5,453,570 | * | 9/1995 | Umeda et al. | 84/636 |
| 5,585,586 | * | 12/1996 | Wakuda | 84/636 |
| 5,973,255 | * | 10/1999 | Tanji | 84/636 |

* cited by examiner

*Primary Examiner*—Stanley J. Witkowski
(74) *Attorney, Agent, or Firm*—Townsend and Townsend and Crew LLP

(57) ABSTRACT

A method and apparatus that allows a musician or disk-jockey to jump to selected beats while playing a digital music file. Numeric pads on a user interface access beat pointers which point to the location of a selected jump beat in the file. The jump beat then replaces or overlays the beat currently being played. Alternatively, a pattern of beats can be selected to overlay the song as it is played.

9 Claims, 4 Drawing Sheets

METHOD AND APPARATUS FOR REAL-TIME BEAT MODIFICATION OF AUDIO AND MUSIC SIGNALS

CROSS-REFERENCE TO RELATED APPLICATIONS

This application is a Continuation-in-Part of Application No. 09/378,279, filed Aug. 20, 1999, entitled "Method and Apparatus for Tempo and Downbeat Detection and Alteration of Rhythm in a Musical Segment" and Application No. 09/378,377, filed Aug. 20, 1999, entitled "Method and Apparatus for Transient Detection and Non-Distortion Time Scaling", the disclosures of which are incorporated herein by reference. This application also claims Benefit of Provisional application Ser. No. 60/117,154, filed Jan. 25, 1999.

BACKGROUND OF THE INVENTION

Popular music increasingly employs electronic instruments and processing equipment such as synthesizers, drum machines, groove machines, samplers, and sequencers. An important advance in this technology has been a beat munging feature which is the subject of the above-referenced copcnding and commonly assigned patent applications.

These applications disclose techniques for processing a digital music file to identify the locations and the beginning of beats. Techniques for changing time signatures, adding swing, reordering the beats of a soing, and mixing beats from different songs are also disclosed.

An important aspect of electronic music-making equipment is the development of interfaces that allow musicians to interact with electronic equipment as if the equipment were a musical instrument. For example, synthesizers are controlled by piano-like keyboards and drum machines include pads that may be struck by sticks or by hand.

Another important aspect of electronic music is remixing or altering existing songs. Sequencers allow bits of songs to be reused in arbitrary ways and the above-described beat munger allows songs to be dissected by beats and the beats to be processed separately.

Accordingly, much research and creative effort is being directed to improve human interactivity with electronic equipment to allow artistic creativity and facilitate a musician friendly interaction with electronic equipment.

SUMMARY OF THE INVENTION

According to one aspect of the invention, an interface and software is provided to facilitate real-time jumping to arbitrarily selected beats in song. The jump beats may be substituted for the beat in the song currently being played or may overlay the current beat.

In one aspect of the invention, an input device including numeric pads is coupled to a general purpose desktop computer. Software on the computer creates an indexed list of beat pointers which point to beginnings of beat segments in the digital music file. When a song is played, a beat counter keeps track of the beat which is currently being played and defines beat intervals between increments of the beat count. If a musician taps one of the numeric pads on the input device a beat pointer to the beat segment is selected and used to access a jump beat segment indicated by the selected beat pointer. This jump beat segment is then played during the current beat interval.

According to another aspect of the invention, the jump beat segment is added to the beat segment indicated by the beat counter to form a summed beat segment. The summed beat segment is then played during the current beat interval so that the jump beat segment overlays the current beat segment and both are played simultaneously.

According to another aspect of the invention, the jump beat segment replaces the current beat segment. Cross-fading is used so that the music doesn't appear to jump or be discontinuous.

According to another aspect of the invention each beat is divided into sub-beats. If a user selects a jump beat segment then the playing of the jump beat segment is delayed until the beginning of the next sub-beat.

According to another aspect of the invention, if a jump beat segment is longer than the current beat segment the jump beat segment is shortened to match the length of the current beat segment before it is played.

According to another aspect of the invention, a musician uses the input device to input a pattern of beat numbers. This pattern of beats overlays the song as played in unaltered manner.

In another embodiment of the invention, a stand alone device, similar to a drum machine, includes numeric input pads, a processor, memory for storing program code and a digital music file, and audio hardware for converting the digital music file to audio. In response to playing the numeric pads the song jumps to beats indicated by the pads.

Other features and advantages of the invention will be apparent from the following detailed description and appended drawings.

BRIEF DESCRIPTION OF THE DRAWINGS

FIG. 4 is a block diagram of a computer system for implementing a preferred embodiment of the invention.

DESCRIPTION OF THE SPECIFIC EMBODIMENTS

Description of Rhythm Modification Techniques

Jumping/playing arbitrary beats in real-time

It is assumed here that the tempo and downbeat of the track has been estimated, either in real-time, as the music is playing, or offline, in a preliminary step. Techniques for determining the tempo and downbeat of a track are disclosed in the above-referenced patent applications to Laroche entitled "Method and Apparatus for Tempo and Downbeat Detection and Alteration of Rhythm in a Musical Segment" and "Method and Apparatus for Transient Detection and Non-Distortion Time Scaling".

Figure 1:
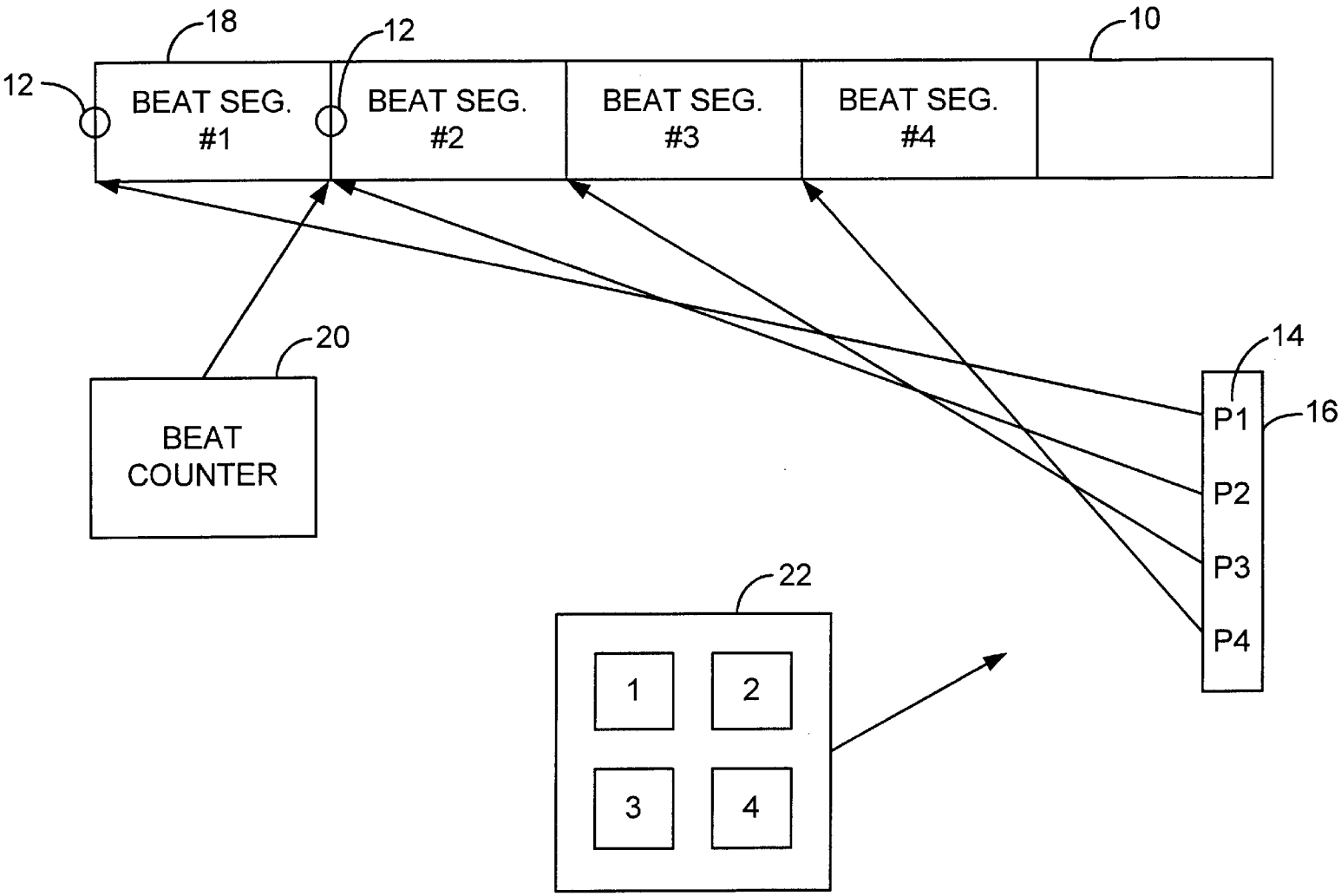
FIG. 1 is an a block diagram depicting an overview of the operation of a preferred embodiment.

An overview of the system is depicted in FIG. 1. A digital music file 10 has been processed to locate downbeats 12. A series of beat pointers 14 is stored in an indexed list 16, e.g., a look-up table, where each beat pointer 14 identifies the location of beat 12 in the musical file. Thus, beat segments 18, i.e., portions of the musical file located between beats 12, have been identified and are accessible using the beat pointers 14. When the musical file is played, bytes of the file are sequentially accessed and provided to the sound card. A beat counter 20 provides a current beat count output that indicates the identity of the beat segment currently being played.

The user is provided with an interface 22 which may be keys on a computer keyboard or buttons on a hardware box, that, when activated, will cause jumps to arbitrary beats in the music, either replacing or overlaying the original material. For example, in one embodiment 4 keys, numbered 1 through 4, correspond to the four beats of the bar currently being played (or 8 keys if two bars of 4 beats are to be used). During nominal playback, the successive beats are played back in order, resulting in no modification of the original signal. When the user hits key #2 however, the original audio is replaced by, or mixed with, the audio located at the second beat of the current bar for a selectable duration (say between ¼th of a beat to a whole beat). At the end of this jump, the playback resumes exactly where it would be if no key had been hit. This is an important feature, as it ensures that the jump will not modify the overall BPM of the track (and in particular, will not alter the duration of the current bar).

A useful feature is to constrain the time at which the jump will start to fall on a subdivision of the current beat (for example on a 1/16th note). In other words, when the user pushes a button, the software/hardware waits until the playback reaches the next subdivision (or quantization grid) and then jumps to the specified beat. This ensures that jumps will occur synchronously with the original beat, and helps preserve the "feel" of the track.

Figure 2:
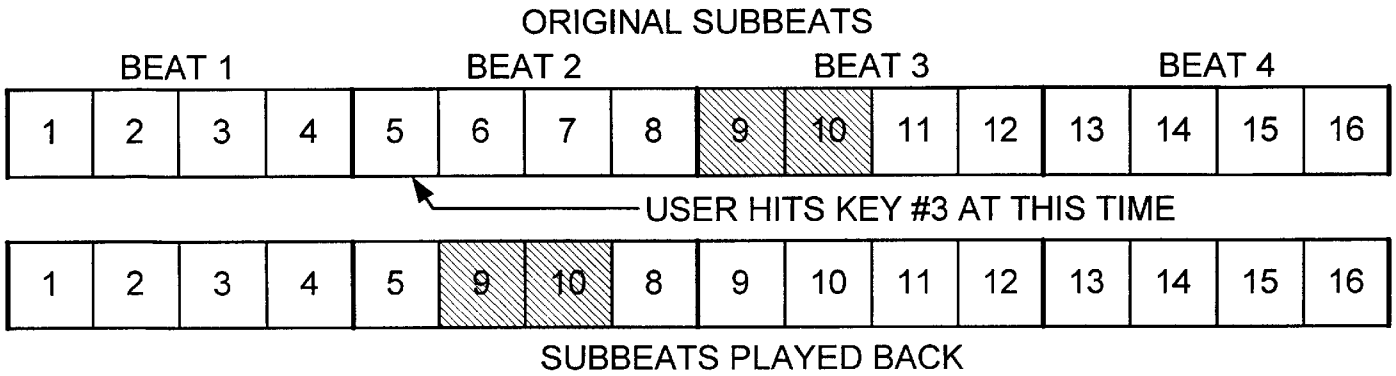
FIG. 2 is diagram depicting quantizing jumps to sub-beat intervals.

Referring to FIG. 2, an example of jumping to a beat is illustrated. During normal playback (top) the sub-beats of each beats are played back in sequence. If during the playback of sub-beat 5 the user hits a button to jump to the third beat, the jump occurs at the beginning of the next sub-beat (sub-beat 6 in the original), but the two first sub-beats of beat 3 (sub-beats 9 and 10, grayed area) are played instead of sub-beat 6 and 7, and then normal playback resumes at sub-beat 8. Notice that cross-fading must be used between sub-beat 5-9 and 10-8 as there is no signal continuity at these points.

Pattern overlay

Figure 3:
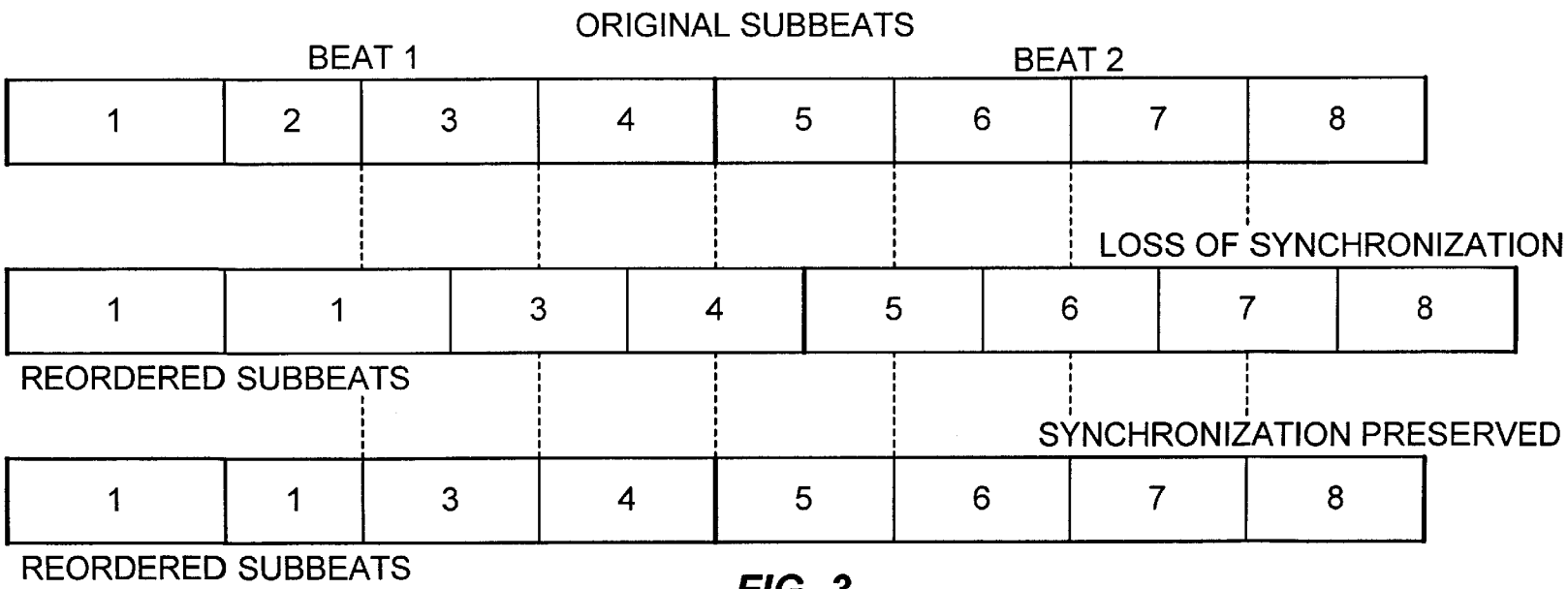
FIG. 3 is a diagram depicting synchronizing beats of different lengths.

The user can select among a number of "patterns" which are manners in which the sub-beats are reordered before playback. For example, each beat can be subdivided into four sub-beats and the 16 sub-beats of a 4 beat bar can be played in an arbitrary manner (sub-beats can be skipped, repeated, played out of order etc). When a pattern is selected in the "replace" mode, the original audio is replaced by the reordered sequence of sub-beats. This is the mode described in the above-referenced patent application. In the "mixing" or "overlay" mode, the reordered sub-beats are superimposed onto the original signal. Two precautions must be taken for this to work well:

Because the duration of each sub-beat might not be the same (except if the tempo is constant), the duration of the reordered bar might not be the same as that of the original bar. This is a problem if the two must be mixed, because they will be out of synch. For example, if the pattern just replaces sub-beat 2 by sub-beat 1 (the pattern plays 1-1-3-4-5-6-7-etc while the original is 1-2-3-4-5-6-7-etc), and sub-beat 2 is shorter than sub-beat 1, when the reordered audio is superimposed to the original audio, the sub-beats after 3 will not fall exactly in synch because playing sub-beat 1 twice took more time that playing sub-beat 1 then 2. This phenomenon is depicted in FIG. 3. To avoid this, it is possible to constrain the duration of each sub-beat in the pattern to match that of the corresponding sub-beat in the original audio. In the example above, the second time sub-beat 1 is played, a small portion of it would be dropped so that its duration matches that of sub-beat 2 (which it is superimposed on). The signals at the boundaries of reordered sub-beats should be cross-faded since they might correspond to very different segments of the original audio (this is described in the original patent).

In a preferred embodiment, when mixing the sub-beats from the pattern and from the original audio, the mixing ratios are adjusted depending on whether or not the same sub-beats are played in the original and in the pattern. This is because when the same sub-beat is played in both, and therefore mixed together, the result is a signal with twice the loudness of the original. However, when two different sub-beats are superimposed, their loudness does not add up because the signals arc "incoherent," and the resulting signal has less loudness. A good rule of thumb is to multiply the scaling factors by ½ when the signals come from the same sub-beat, and by 1/√2 when they come from different sub-beats. The same remark applies to the jumps above.

Referring to FIG. 3, playback of a reordered sequence of sub-beats is illustrated. Here, the pattern simply replaces sub-beat 2 by sub-beat 1, but since in the original signal (top) sub-beat 1 is longer than sub-beat 2, replacing sub-beat 2 by sub-beat 1 yields a sequence in which subsequent sub-beats arc no long synchronized with the original sub-beats (middle). When the two signals arc added together, the result can exhibit phasing (for small length discrepancy) or echo-like artifacts (for longer discrepancies). By contrast, if sub-beat 1 when repeated, is given the length of sub-beat 2, then subsequent sub-beats are still synchronized with the original sub-beats, and they can be mixed together without any problem.

Implementation Details

Jumps

As the music is analyzed in real-time, the software maintains a list of pointers to samples located at the beginning of each beats in the audio. For example, pointer 1 will point to the sample at the beginning of beat 1, and so on. The software also maintains a beat counter that indicates which beat is currently playing. The counter also keeps track of which fraction of the beat is currently playing: for example if the playback is currently at the middle of beat 1, then the counter would indicate that beat 1 is currently being played, and that half of the beat has already been played. When the user hits a jump key, for example the "Jump to beat 3" key, two things can happen, depending on whether or not jumps are quantized to a subdivision of the beat.

1. If jumps are quantized, the software will wait until the sample currently being played back is at an exact subdivision of the beat (for example, exactly at the beginning of beat 1, or at ¾ of beat 1). For a coarse quantization, the beat is divided into few sub-beats, for example 2. For a fine quantization, there are more subdivisions (for example 16 per beat). When the playback has reached an exact subdivision of the beat, the software initiates the jump.

2. If jumps are not quantized, the software initiates the jump immediately. The process is as follows:

The software looks up in the list of pointers which sample corresponds to the start of the beat we want to jump to.

The signal at this location is then added to the current signal being played back (the "direct" signal), or replaces it, depending on whether the "overlay" or "replace" mode is active. In order to avoid discontinuities, cross-fading is used: A cross-fade (a ramp increasing from 0 to 1, in so many milliseconds) is applied to the signal at the beginning of the jump. In "replace" mode, a decreasing ramp is applied simultaneously to the "direct" signal so its level drops to 0, and the cross-faded jump signal is added to it. In "overlay" mode, the direct signal is not muted and there's no need for a decreasing ramp: the cross-faded jump signal is simply added to it.

Figure 4:
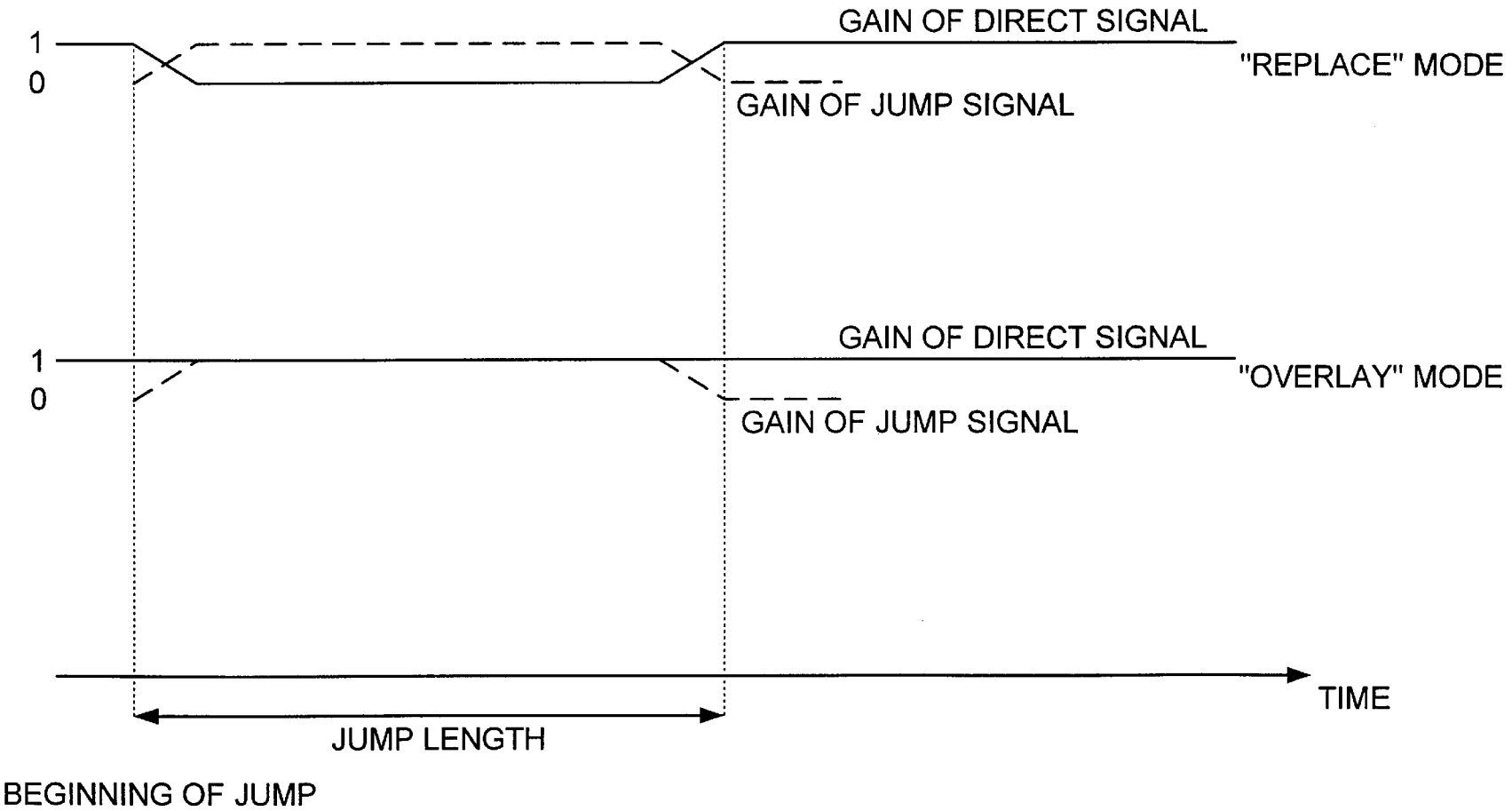
FIG. 4 is graph depicting cross-fading to eliminate audio artifacts.

For the duration of the jump (which can be selected by the user), the two signals are mixed together and played back. In "replace" mode, the direct signal is mixed with a zero gain (i.e., is inaudible). At the end of the jump, the jump signal is cross-faded (i.e., a ramp decreasing from 1 to 0 in so many ms is applied to it) so it disappears from the output. In the "replace" mode, an ramp increasing from 0 to 1 is applied to the direct signal so it becomes audible again. FIG. 4 illustrates how the gains are set for each signal before, during and after a jump.

Referring to FIG. 4, gains of the direct and jump signals before during and after a jump are illustrated. In "replace" mode, the direct signal fades out at the beginning of the jump while the jump signal fades in. In "overlay" mode, the jump signal fades in at the beginning of the jump, and fades out at the end.

Patterns

Patterns are handled in very much the same manner as are jumps to arbitrary beats. The pattern is an ordered list of sub-beat numbers which indicates how sub-beats should be played. At the beginning of the bar, the software looks up the number of the first sub-beat to play from the pattern list. The playback then starts playing this sub-beat, for a duration equal to the duration of the original sub-beat (i.e., sub-beat 1 in the non-reordered bar), as explained above. At the end of this sub-beat, the software looks up the next sub-beat to be played and switch the playback to it. Cross-fading is used between each sub-beat to avoid discontinuities in the signal, when switching from one sub-beat to the next.

Figure 5:
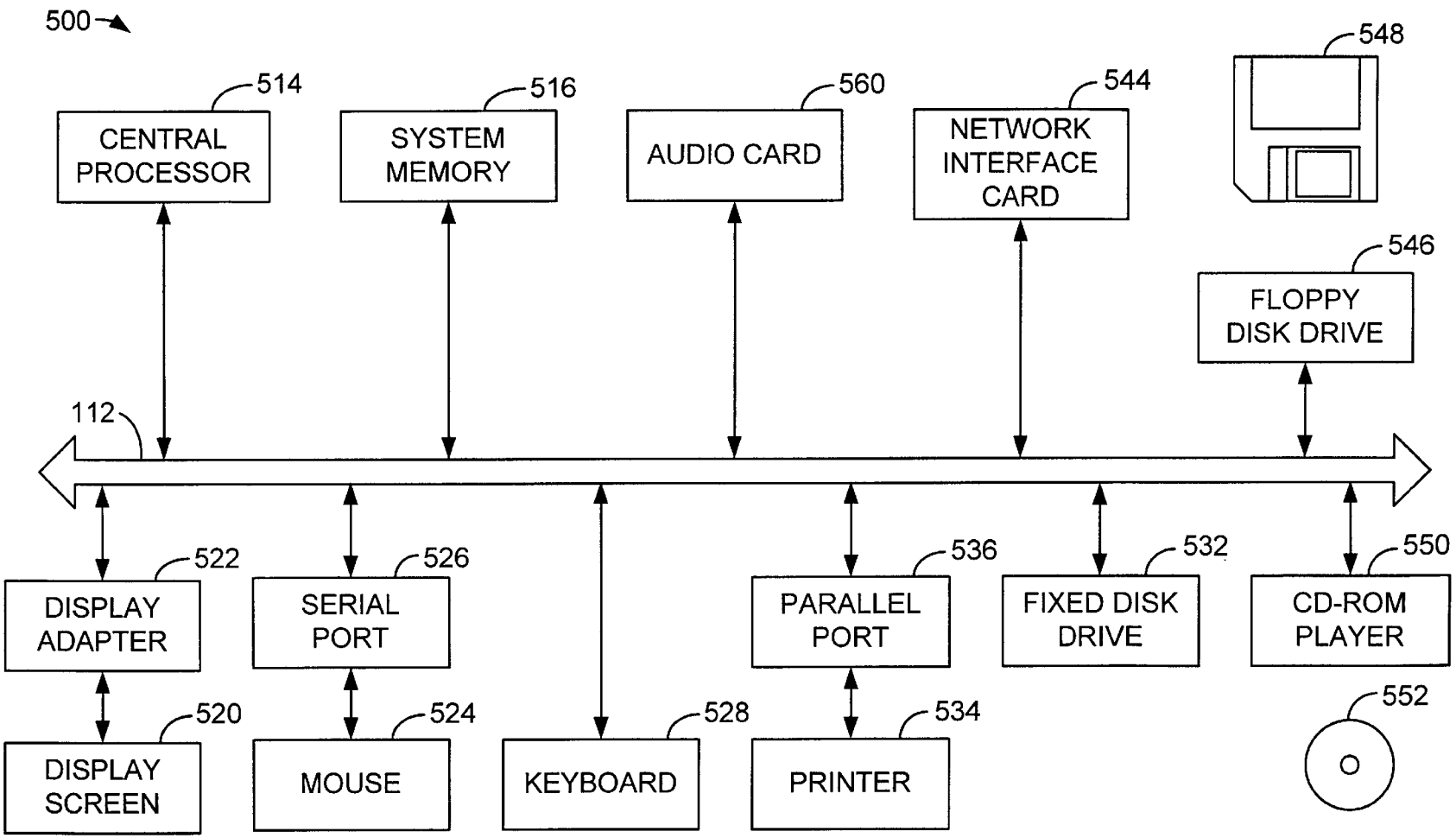
FIG. 5 is a diagram depicting a stand-alone embodiment of the invention.

FIG. 5 shows the basic subsystems of a computer system 500 suitable for implementing some embodiments of the invention. In FIG. 5, computer system 500 includes a bus 512 that interconnects major subsystems such as a central processor 514 and a system memory 516. Bus 512 further interconnects other devices such as a display screen 520 via a display adapter 522, a mouse 524 via a serial port 526, a keyboard 528, a fixed disk drive 532, a printer 534 via a parallel port 536, a network interface card 544, a floppy disk drive 546 operative to receive a floppy disk 548, a CD-ROM drive 550 operative to receive a CD-ROM 552, and an audio card 560 which may be coupled to a speaker (not shown) to provide audio output. Source code to implement some embodiments of the invention may be operatively disposed in system memory 516, located in a subsystem that couples to bus 512 (e.g., audio card 560), or stored on storage media such as fixed disk drive 532, floppy disk 548, or CD-ROM 552.

Many other devices or subsystems (not shown) can be also be coupled to bus 512, such as an audio decoder, a sound card, and others. Also, it is not necessary for all of the devices shown in FIG. 11 to be present to practice the present invention. Moreover, the devices and subsystems may be interconnected in different configurations than that shown in FIG. 11. The operation of a computer system such as that shown in FIG. is readily known in the art and is not discussed in detail herein.

Bus 512 can be implemented in various manners. For example, bus 512 can be implemented as a local bus, a serial bus, a parallel port, or an expansion bus (e.g., ADB, SCSI, ISA, EISA, MCA, NuBus, PCI, or other bus architectures). Bus 512 provides high data transfer capability (i.e., through multiple parallel data lines). System memory 516 can be a random-access memory (RAM), a dynamic RAM (DRAM), a read-only-memory (ROM), or other memory technologies.

In a preferred embodiment, the audio file is stored in digital form and stored on the hard disk drive or a CD ROM and loaded into memory for processing. The CPU executes program code loaded into memory from, for example, the hard drive and processes the digital audio file to perform transient detection and time scaling as described above.

An alternative embodiment, similar to a drum machine, is a self-contained unit including a numeric pad, processor, memory, and sound generating hardware. A musician or disk-jockey can modify the beat of a song being, played in realtime.

The invention has now been described with reference to the preferred embodiments. Alternatives and substitutions will now be apparent to persons of skill in the art. In particular, although a numeric keypad has been described as an interface numerous alternative such as a keyboard, dlrmheads, or screen displays could be used to select the jump beats. Accordingly, it is not intended to limit the invention except as provided by the appended claims.

What is claimed is:

1. A method, performed by a digital computer system executing program code, for playing a digital music file and altering the play order of a digital music file stored in addressable storage locations in a computer memory, said method comprising the steps of:

creating an indexed list of beat pointers, with each beat pointer indexed by a beat number and pointing to corresponding beat segments of the digital music file;

maintaining a beat counter indicating the beat number of a current beat segment being played where the beat counter increments at beat intervals equal to the time required to play a beat segment of the digital music file;

in response to user selection of an arbitrary beat number during a current beat interval indicated by a current beat counter value:

using the arbitrary beat number as an index to access a jump beat pointer from the indexed list;

accessing a jump beat segment pointed to by the accessed beat pointer;

playing the jump beat segment during the current beat interval;

teiiiating playing the jump beat segment when the beat counter increments; and playing a following beat segment indicated by the value of the incremented beat counter after the beat counter increments.

2. The method of claim 1 further comprising the step of:

adding the jump beat segment to a current beat segment indicated by the current beat pointer to form a summed beat segment;

playing the summed beat segment during the current beat interval so that jump beat segment overlays the current beat segment.

3. The method of claim 1 further comprising adding sub-beat pointers to said pointer list, with each sub-beat pointer pointing to a corresponding sub-segment of a beat segment;

incrementing the beat counter at sub-beat intervals equal to the time to play a sub-beat portion of the digital music file;

if a user selects an arbitrary beat during playing of a sub-beat segment, delaying playing an accessed beat segment until the beat counter increments to the next sub-beat thereby synchronizing the jump segment to the sub-beat pattern of the digital music file.

4. The method of claim 1 further comprising the acts of:

determining the length of the jump beat segment;

determining the length of a following beat segment indicated when the counter increments;

if the jump beat segment is longer than the following beat segment, forming a truncated the jump beat segment to equal the length of the following beat segment;

playing the truncated beat segment when the beat counter increments.

5. The method of claim 1 further comprising the step of:

stopping playing of a current beat segment indicated by the current beat counter when the jump beat segment is played so that the current beat segment is replaced by the jump beat segment.

6. The method of claim 5 further comprising the acts of. fading out the current beat segment and fading in the jump beat segment when the accessed beat segment replaces the current beat segment; and fading out the jump beat segment when the jump beat segment completes playing.

7. A system for playing a digital music file and altering the play order of the digital music file, said system comprising:

a digital computer including a processing unit for executing program code and a sound generating system for converting a digital musical file to audio;

an input device, coupled to the digital computer, with the input device including numbered input pads for allowing a user to select an arbitrary jump beat;

a memory for storing a digital music file and computer readable program code, with said computer readable program code comprising:

program code for causing said computer to create an indexed list of beat pointers, with each beat pointer indexed by a beat number and pointing to a corresponding beat segment of the digital music file;

program code for causing said computer to maintain a beat counter indicating the beat number of a current beat segment being played where the beat counter increments at beat intervals equal to the time required to play a beat segment of the digital music file;

program code for causing said computer to respond to user activation of a numbered pad to select an arbitrary beat number during a current beat interval indicated by a current beat counter value:

to use the arbitrary beat number as an index to access a jump beat pointer from the indexed list;

to access a jump beat segment pointed to by the accessed beat pointer;

to play the jump beat segment during the current beat interval terminating playing the jump beat segment when the beat counter increments; and to play a following beat segment indicated by the value of the incremented beat counter after the beat counter increments.

8. A method, performed by a digital computer system executing program code, for playing a digital music file and altering the play order of a digital music file stored in addressable storage locations in a computer memory, said method comprising the steps of:

creating an indexed list of beat pointers, with each beat pointer indexed by a beat number and pointing to corresponding beat segments of the digital music file;

maintaining a beat counter indicating the beat number of a current beat segment being played where the beat counter increments at beat intervals equal to the time required to play a beat segment of the digital music file;

in response to user selection of a pattern of arbitrary beat numbers:

storing the pattern as an altered play list;

using the altered play list entries as indices to access jump beat pointers from the indexed list;

accessing a first jump beat segment pointed to by a first beat pointer accessed from the altered play list;

summing the first jump beat segment and a first beat segment selected by the beat counter to form a first summed beat segment;

playing the first summed beat segment during a first beat interval defined by the beat counter;

terminating playing the first summed beat segment when the beat counter increments;

accessing a second jump beat segment pointed to by a second beat pointer accessed from the altered play list;

summing the second jump beat segment and a second beat segment selected by the beat counter to form a second summed beat segment;

playing the second summed beat segment during a second beat interval defined by the beat counter;

terminating playing the second summed beat segment when the beat counter increments.

9. The method of claim 8 further comprising the act of:

cross-fading the first and second summed beat segment to eliminate audio artifacts.

* * * * *